US009759454B2

(12) United States Patent
Choi et al.

(10) Patent No.: US 9,759,454 B2
(45) Date of Patent: Sep. 12, 2017

(54) CASCADE HEAT PUMP

(71) Applicant: LG ELECTRONICS INC., Seoul (KR)

(72) Inventors: Jaeheuk Choi, Seoul (KR); Taehee Kwak, Seoul (KR); Yoonho Yoo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 952 days.

(21) Appl. No.: 13/737,995

(22) Filed: Jan. 10, 2013

(65) Prior Publication Data

US 2013/0180276 A1 Jul. 18, 2013

(30) Foreign Application Priority Data

Jan. 10, 2012 (KR) ..... 10-2012-0002806

(51) Int. Cl.
*F25B 7/00* (2006.01)
*F25B 27/00* (2006.01)
(Continued)

(52) U.S. Cl.
CPC ..... *F25B 7/00* (2013.01); *F25B 1/10* (2013.01); *F25B 13/00* (2013.01); *F25B 2400/13* (2013.01)

(58) Field of Classification Search
CPC .... F25B 1/10; F25B 7/00; F25B 13/00; F25B 2400/075; F25B 30/02; F25B 40/00;
(Continued)

(56) References Cited

U.S. PATENT DOCUMENTS 5,570,585 A 11/1996 Vaynberg
6,568,198 B1 * 5/2003 Tadano ..... F25B 1/10 62/217
(Continued)

FOREIGN PATENT DOCUMENTS

CN 1847750 A 10/2006
CN 101080597 A 11/2007
(Continued)

OTHER PUBLICATIONS

European Search Report dated May 24, 2016.
(Continued)

*Primary Examiner* — Frantz Jules
*Assistant Examiner* — Meraj A Shaikh
(74) *Attorney, Agent, or Firm* — Ked & Associates LLP

(57) ABSTRACT

Provided is a cascade heat pump. The cascade heat pump includes a first refrigerant cycle including a first compressor and a first indoor heat exchanger, a second refrigerant cycle including a second compressor and a second indoor heat exchanger, an outdoor heat exchanger in which a refrigerant compressed in the first compressor or the second compressor is condensed, a bypass tube allowing the refrigerant compressed in the second compressor to bypass the first compressor, thereby flowing into a discharge side of the first compressor, and a first flow rate regulating part disposed on a discharge side of the second compressor to introduce the refrigerant discharged from the second compressor into one of the first compressor and the bypass tube.

10 Claims, 11 Drawing Sheets

(51) Int. Cl.
*F25B 1/10* (2006.01)
*F25B 13/00* (2006.01)

(58) Field of Classification Search
CPC .... F25B 5/02; F25B 49/02; F25B 6/04; F25B 40/02; F04C 23/001; F24D 2200/123; F24D 19/1039; F24D 3/18; F24D 17/02; F24D 19/1054
USPC ..... 62/196.2, 510, 513, 217, 196.3
See application file for complete search history.

(56) References Cited

U.S. PATENT DOCUMENTS

| | | | | |
|---|---|---|---|---|
| 2013/0104582 | A1* | 5/2013 | Sandkoetter ..... | F25B 1/10 62/196.3 |
| 2013/0227979 | A1* | 9/2013 | Kasuka ..... | F25B 1/00 62/175 |

FOREIGN PATENT DOCUMENTS

| | | | | | |
|---|---|---|---|---|---|
| CN | 101755175 | A | | 6/2010 | |
| JP | 54-85455 | | | 7/1979 | |
| JP | 04-198670 | | | 7/1992 | |
| JP | H04-332350 | A | | 11/1992 | |
| JP | 9-145188 | | | 6/1997 | |
| JP | H10-122677 | A | | 5/1998 | |
| JP | 2000-314566 | | | 11/2000 | |
| JP | 2002-407027 | | | 4/2002 | |
| JP | 2003-202161 | | | 7/2003 | |
| JP | 2004-271123 | | | 9/2004 | |
| JP | 2005-106366 | | | 4/2005 | |
| JP | 2005106366 | A | * | 4/2005 | ..... F25B 13/00 |
| JP | 2007-132628 | | | 5/2007 | |
| JP | 2008-249219 | | | 10/2008 | |
| JP | 2009-270773 | A | | 11/2009 | |
| JP | 2011-149695 | A | | 8/2011 | |
| KR | 2003-00071607 | A | | 9/2003 | |
| KR | 10-0639104 | B1 | | 10/2006 | |
| KR | 10-0865093 | | | 10/2008 | |
| KR | 100865093 | B1 | * | 10/2008 | ..... F25B 1/10 |
| WO | WO 2010/036540 | | | 4/2010 | |

OTHER PUBLICATIONS

Chinese Search Report dated Aug. 19, 2014, issued in Application No. 2013100099648.
Chinese Office Action dated Sep. 22, 2014, issued in Application No. 2013100099648.8 (English translation).
Japanese Office Action dated Nov. 12, 2013.
Japanese Office Action dated Jul. 1, 2014.

* cited by examiner

CASCADE HEAT PUMP

CROSS-REFERENCE TO RELATED APPLICATIONS

The present application claims priority under 35 U.S.C. 119 and 35 U.S.C. 365 to Korean Patent Application No. 10-2012-0002806 (filed on Jan. 10, 2012), which is hereby incorporated by reference in its entirety.

BACKGROUND

The present disclosure relates to a cascade heat pump.

In general, heat pumps are apparatuses for air-conditioning an indoor room or refrigerating or freezing foods using a refrigerant circulating into a refrigerant cycle including a compressor for compressing the refrigerant, a condenser for condensing the refrigerant discharged from the compressor, an expander for expanding the refrigerant passing through the condenser, and an evaporator for evaporating the refrigerant expanded by the expander.

Recently, to improve efficiency of a system, a cascade heat pump including a first refrigerant cycle in which a first refrigerant circulates and a second refrigerant cycle in which a second refrigerant circulates to heat-exchange the first refrigerant with the second refrigerant through a refrigerant heat exchanger is being developed.

In this case, the first refrigerant cycle may be used as a cycle for air-conditioning an indoor room, and the second refrigerant cycle may be used as a cycle for refrigerating or freezing foods. Here, the first refrigerant may be evaporated in the refrigerant heat exchanger, and the second refrigerant may be condensed to heat-exchange the first refrigerant with the second refrigerant.

Also, a flow direction of the first refrigerant circulating into the first refrigerant cycle may be switched according to the switching of a cooling/heating operation mode. However, the second refrigerant circulating into the second refrigerant cycle may circulate always in the same direction.

In the cascade heat pump which realizes the air-conditioning operation or the refrigerating or freezing operation according to the related art, the refrigerant circulating in the refrigerant cycle is compressed using one compressor. Thus, a compression ratio may be decreased, and efficiency of the cascade heat pump may be reduced.

SUMMARY

Embodiments provide a cascade heat pump which compresses a refrigerant in two stages using a compressor of a freezing cycle and a compressor of a refrigerating cycle to realize a high compression ratio and improve efficiency, and an operation method thereof.

In one embodiment, a cascade heat pump includes: a first refrigerant cycle including a first compressor and a first indoor heat exchanger; a second refrigerant cycle including a second compressor and a second indoor heat exchanger; an outdoor heat exchanger in which a refrigerant compressed in the first compressor or the second compressor is condensed; a bypass tube allowing the refrigerant compressed in the second compressor to bypass the first compressor, thereby flowing into a discharge side of the first compressor; and a first flow rate regulating part disposed on a discharge side of the second compressor to introduce the refrigerant discharged from the second compressor into one of the first compressor and the bypass tube.

In another embodiment, a cascade heat pump includes: a refrigerating cycle including a refrigerating compressor and a refrigerating indoor heat exchanger; a freezing cycle including a freezing compressor and a freezing indoor heat exchanger; an outdoor heat exchanger in which a refrigerant compressed in the refrigerating compressor or the freezing compressor is condensed; an air-conditioning cycle including an air-conditioning compressor and an air-conditioning indoor heat exchanger; a refrigerant heat exchanger disposed on a side of the outdoor heat exchanger to heat-exchange the refrigerant condensed in the outdoor heat exchanger with a refrigerant circulating into the air-conditioning cycle; and a first flow rate regulating part disposed on a discharge side of the freezing compressor to adjust a flow direction of the refrigerant so that the refrigerant compressed in the freezing compressor is compressed in two stages in the refrigerating compressor.

The details of one or more embodiments are set forth in the accompanying drawings and the description below. Other features will be apparent from the description and drawings, and from the claims.

DETAILED DESCRIPTION OF THE EMBODIMENTS

Figure 1:
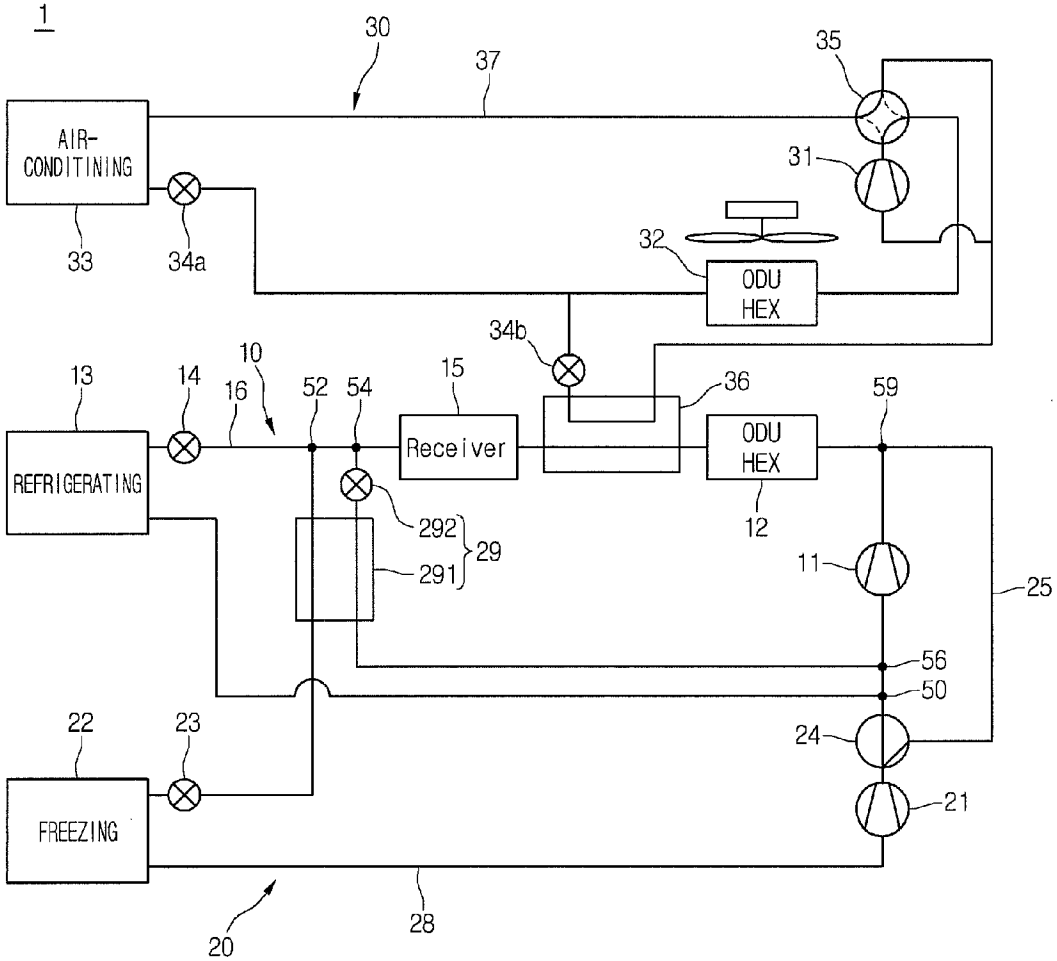
FIG. 1 is a view of a cascade heat pump according to a first embodiment.

FIG. 1 is a view of a cascade heat pump according to a first embodiment.

Referring to FIG. 1, a cascade heat pump 1 according to the first embodiment includes a first refrigerant cycle 10, a second refrigerant cycle 20, and a third refrigerant cycle 30.

The first refrigerant cycle 10 includes a first compressor 11, a first outdoor heat exchanger 12, a first indoor heat exchanger 13, and a first expander 14 in which a first refrigerant circulates. Also, the first refrigerant cycle 10 further includes a first refrigerant tube 16 connecting the first compressor 11, the first outdoor heat exchanger 12, the first indoor heat exchanger 13, and the first expander 14 to each other to guide the circulation of the first refrigerant. Here, the first compressor 11 may be called a "refrigerating compressor". Also, the first indoor heat exchanger 13 may be called a "refrigerating indoor heat exchanger", and the first refrigerant cycle may be called a "refrigerating cycle".

The first refrigerant cycle 10 may be a refrigerating cycle. In the refrigerating cycle, the first refrigerant may be condensed by air passing through the first outdoor heat exchanger 12 and evaporated in the first indoor heat exchanger 13.

The first refrigerant may be heat-exchanged within a refrigerant heat exchanger 36 (that will be described later) with a third refrigerant circulating in the third refrigerant cycle 30. For example, when the first refrigerant and the third refrigerant are heat-exchange with each other, the first refrigerant is condensed, and condensed heat of the first refrigerant is transferred into the third refrigerant to evaporate the third refrigerant.

The first refrigerant cycle 10 may further include a receiver 15 for storing the first refrigerant. The receiver 15 may adequately adjust an amount of first refrigerant to be introduced into the first indoor heat exchanger 13 after passing through the first outdoor heat exchanger 12 or an amount of second refrigerant to be introduced into a second indoor heat exchanger 22 after passing through the first outdoor heat exchanger 12. That is, the receiver 15 may store the first refrigerant or the second refrigerant. The receiver 15 may be a receiver.

The first refrigerant compressed in the first compressor 11 may be stored in the receiver 15 after being condensed in the first outdoor heat exchanger 12. Then, the first refrigerant may be evaporated in the first indoor heat exchanger 13 to cool surrounding thereof, i.e., a first storage compartment (refrigerating compartment).

The second refrigerant cycle 20 includes a second compressor 21, the first outdoor heat exchanger 12, a second indoor heat exchanger 22, and a second expander 23 in which the second refrigerant circulates. Also, the second refrigerant cycle 20 further includes a second refrigerant tube 28 connecting the second compressor 21, the first outdoor heat exchanger 12, the second indoor heat exchanger 22, and the second expander 23 to each other to guide the circulation of the second refrigerant. The second compressor 21 may be called a "freezing compressor". Also, the second indoor heat exchanger 22 may be called a "freezing indoor heat exchanger", and the second refrigerant cycle may be called a "freezing cycle".

The second refrigerant cycle 10 may be a freezing cycle. In the freezing cycle, the second refrigerant may be introduced into the first outdoor heat exchanger 12 and condensed. Then, the second refrigerant may be evaporated in the second indoor heat exchanger 22. The second refrigerant cycle 20 may share a condenser (the first outdoor heat exchanger 12) with the first refrigerant cycle 10.

The second refrigerant may be equal to the first refrigerant. That is, the first and second refrigerant cycles 10 and 20 use the same refrigerant. In the current embodiment, one refrigerant may be distributed to operate the first and second refrigerant cycles 10 and 20, i.e., the refrigerating cycle and the freezing cycle.

Like the first refrigerant, the second refrigerant may be heat-exchanged within the refrigerant heat exchanger 36 with the third refrigerant circulating in the third refrigerant cycle 30. Condensed heat of the first and second refrigerants may be transferred into the third refrigerant to evaporate the third refrigerant.

The second refrigerant cycle 20 may share the receiver 15 with the first outdoor heat exchanger 12 of the first refrigerant cycle 10. That is, the second refrigerant compressed in the second compressor 21 may be stored in the receiver 15 after being condensed in the first outdoor heat exchanger 12. Then, the second refrigerant may be evaporated in the second indoor heat exchanger 22 to cool surrounding thereof, i.e., a second storage compartment (freezing compartment).

The second refrigerant cycle 20 may further include a first flow rate regulating part 24 and a bypass tube 25.

The first flow rate regulating part 24 may be disposed on a point between an outlet side of the second compressor 21 and an inlet side of the first compressor 11. The second refrigerant passing through the second compressor 21 may be introduced into the first compressor 11 through the first flow rate regulating part 24.

For this, the second refrigerant tube 28 may be connected to a point of the first refrigerant tube 16. In detail, a first joint part 50 to which the second refrigerant tube 28 is jointed is disposed on the first refrigerant tube 16. The refrigerant discharged from the second compressor 21 may be introduced into the first compressor 11 through the first flow rate regulating part 24 and the first joint part 50. That is to say, the first flow rate regulating part 24 may be disposed between a discharge end of the second compressor 24 and the first joint part 50.

The first flow rate regulating part 24 may be a four-way valve. However, in the current embodiment, the first flow rate regulating part 24 is not limited to the four-way valve. For example, various valves which are capable of switching a flow direction of the second refrigerant may be used as the first flow rate regulating part 24.

The second refrigerant discharged from the second compressor 21 may be introduced into the first compressor 11 by the first flow rate regulating part 24. Alternatively, the second refrigerant discharged from the second compressor 21 may meet the first refrigerant discharged from the first compressor 11 along the bypass tube 24 by the first flow rate regulating part 24.

A first branch part 52 from which the second refrigerant tube 28 is branched is disposed on the first refrigerant tube 16. The first branch part 52 is disposed on a side of an outlet of the receiver 15. At least one portion (the second refrigerant) of the refrigerant passing through the receiver 15 may flow toward the second expander 23 via the first branch part 52. Also, the rest refrigerant (the first refrigerant) of the refrigerant passing through the receiver 15 may flow toward the first expander 14 via the first branch part 52.

The refrigerant (the second refrigerant) flowing into the second refrigerant cycle 20 may be controlled to pass through the first compressor 11. That is, the second refrigerant may be compressed firstly by the second compressor 21. Then, a flow direction of the second refrigerant may be switched by the first flow rate regulating part 24 and then the second refrigerant may be introduced into the first compressor 11. Thereafter, the second refrigerant may be compressed secondly by the first compressor 11.

In a case where high compression is required for securing refrigerating performance, if a refrigerant is compressed by only one compressor, the compressor may be excessively operated to reduce efficiency. Thus, in the current embodiment, if preset conditions are satisfied, the second refrigerant is compressed firstly in the second compressor 21, and then is compressed secondly in the first compressor 11 to secure a high compression ratio and improve efficiency, thereby reduce power consumption. For example, the first compressor 11 may be a constant compressor, and the second compressor 21 may be an inverter compressor.

Figure 7:
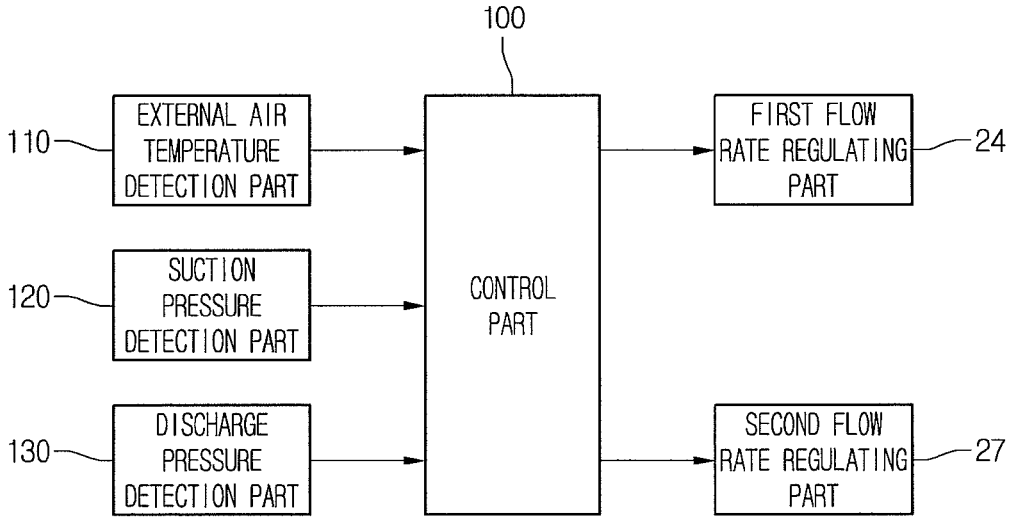
FIG. 7 is a block diagram of the cascade heat pump according to the second embodiment.

The preset conditions may represent a case in which external air has a temperature greater than a reference value. Since external air has a relatively high temperature in summer, a refrigerant should be sufficiently compressed to smoothly realize the refrigerating cycle. Thus, in the current embodiment, if external air has a temperature greater than the reference value, the second refrigerant may be successively compressed in the second compressor 21 and the first compressor 11. A temperature of the external air may be detected by an external air temperature detection part (see reference numeral 110 of FIG. 7). Also, a control part (see reference numeral 100 of FIG. 7) may control an operation of the first flow rate regulating part 24 on the basis of information recognized by the external air temperature detection part 110.

The bypass tube 25 is connected to the first flow rate regulating part 24 to allow the second refrigerant to bypass the first compressor 11. On the other hand, the bypass tube 25 has one end connected to a discharge side of the second compressor 21, i.e., the first flow rate regulating part 24 and the other end connected to a discharge side of the first compressor 11, i.e., a fourth joint part 59.

When the first flow rate regulating part 24 is controlled so that the second refrigerant flows into the bypass tube 25, the second refrigerant is introduced into the bypass tube 25 via the first flow rate regulating part 24, but is not introduced into the first compressor 11. Then, the second refrigerant may be mixed with the first refrigerant in the fourth joint part 59 to flow into the first outdoor heat exchanger 12.

In this case, the first refrigerant circulating into the first refrigerant cycle 10 is compressed in the first compressor 11, and the second refrigerant circulating into the second refrigerant cycle 20 is compressed in the second compressor 21. That is, the first and second refrigerants may be compressed in the first and second compressors 11 and 12, respectively.

On the other hand, when the first flow rate regulating part 24 is controlled so that the second refrigerant compressed in the second compressor 21 passes through the first joint part 50, the second refrigerant is introduced into the first compressor 11 via the first flow rate regulating part 24. Then, the second refrigerant may be compressed again in the first compressor 11.

In this case, the first refrigerant discharged from the first indoor heat exchanger 13 and the second refrigerant discharged after being compressed in the second compressor 21 may be mixed with each other in the first joint part 50 and then introduced into the first compressor 11. The first and second refrigerants compressed in the first compressor 11 may be distributed in the first branch part 52 after passing through the first outdoor heat exchanger 12 and the receiver 15, and then be respectively introduced into the first indoor heat exchanger 13 and the second indoor heat exchanger 22.

When the first and second refrigerants are introduced into the first and second indoor heat exchangers 13 and 22, an opened degree of each of the first and second expanders 14 and 23 may be adjusted. Thus, the first and second refrigerants may be phase-shifted in states required for refrigerating or freezing.

The second refrigerant cycle 20 may further include a supercooling device 29. The supercooling device 29 is configured to supercool the second refrigerant heat-exchanged with the third refrigerant in the refrigerant heat exchanger 36.

The supercooling device 29 may include a supercooling expander 292 for expanding a portion of the refrigerant passing through the refrigerant heat exchanger 36 and a supercooling heat exchanger 291 for heat-exchanging the refrigerant expanded by the supercooling expander 292 with the refrigerant introduced from the refrigerant heat exchanger 36 into the second indoor heat exchanger 22.

Also, a second branch part 54 in which at least one portion of the refrigerant passing through the receiver 15 is branched into the supercooling device 29 is disposed in the first refrigerant tube 16. The refrigerant branched by the second branch part 54 may be introduced into the supercooling heat exchanger 291 via the supercooling expander 292.

That is, the refrigerant discharged from the refrigerant heat exchanger 36 may pass through the receiver 15 and be branched in the second branch part 54, and then introduced into the supercooling device 29. Here, the refrigerant (that is called a branched refrigerant) introduced into the supercooling expander 292 is evaporated in the supercooling heat exchanger 291.

Then, the evaporated refrigerant flows into a second joint part 56 of the first refrigerant tube 16 and is mixed with the first refrigerant in the second joint part 56, and then is introduced into the first compressor 11. The second joint part 56 may be disposed on a point of the inlet side of the first compressor 11 in the first refrigerant tube 16.

On the other hand, the refrigerant (that is called the second refrigerant) branched toward the second indoor heat exchanger 22 in the first branch part 52 may be heat-exchanged with the branched refrigerant and be supercooled in the supercooling heat exchanger 291. Thus, since the second refrigerant is supercooled in the supercooling device 29 and introduced into the second indoor heat exchanger 22, heat exchange efficiency in the second indoor heat exchanger 22 may be improved. As a result, the freezing compartment may be sufficiently cooled.

A portion of the refrigerant passing through the refrigerant heat exchanger 36 may flow into the first expander 14 and be evaporated in the first indoor heat exchanger 13.

The third refrigerant cycle 30 includes a third compressor 31, a third outdoor heat exchanger 32, a third indoor heat exchanger 33, and a plurality of expanders 34*a* and 34*b*, in which a third refrigerant circulates. Also, the third refrigerant cycle 30 further includes a third refrigerant tube 37 connecting the third compressor 31, the third outdoor heat exchanger 32, the third indoor heat exchanger 33, the third expander 34*a*, and the fourth expander 34*b* to each other to guide the circulation of the third refrigerant. The third compressor may be called an "air-conditioning compressor". Also, the third indoor heat exchanger 33 may be called an "air-conditioning indoor heat exchanger", and the third refrigerant cycle may be called an "air-conditioning cycle".

The plurality of expanders 34*a* and 34*b* includes the third expander 34*a* and the fourth expander 34*b*. The third expander 34*a* may be disposed on a side of the third indoor heat exchanger 33, and the fourth expander 34*b* may be disposed on a side of the refrigerant heat exchanger 36.

Also, a third flow rate regulating part 35 for switching a flow direction of the refrigerant according to the cooling or heating operation is disposed on an outlet side of the third compressor 31. The third flow rate regulating part 35 may control the third refrigerant so that the third refrigerant discharged from the third compressor 31 is introduced into the third indoor heat exchanger 33 or the third heat exchanger 32 or so that the third refrigerant evaporated in the third indoor heat exchanger 33 or the third outdoor heat exchanger 32 is introduced into the third compressor 31.

When the cooling operation is performed, the refrigerant compressed in the third compressor 31 may pass through the third flow rate regulating part 35 and then be heat-exchanged (condensed) with external air in the third outdoor heat exchanger 32. Then, the refrigerant may be expanded by the third expander 34*a* or the fourth expander 34*b*, and then be evaporated in the third indoor heat exchanger 33 or the refrigerant heat exchanger 36.

On the other hand, when the heating operation is performed, the refrigerant compressed in the third compressor 31 may be condensed in the third indoor heat exchanger 33 via the third flow rate regulating part 35. Then, the refrigerant may be expanded in the third expander 34*a* or the fourth expander 34*b*, and then be evaporated in the third outdoor heat exchanger or the refrigerant heat exchanger 36.

The third refrigerant cycle 30 may be an air-conditioning cycle for cooling or heating an indoor space. That is, the third refrigerant and indoor air may be heat-exchanged with each other in the third indoor heat exchanger 33 to air-condition the indoor space, thereby providing an indoor environment desired by the user.

The third refrigerant circulating into the third refrigerant cycle may be heat-exchanged with the first refrigerant circulating into the first refrigerant cycle 10 and the second refrigerant circulating into the second refrigerant cycle 20 in the refrigerant heat exchanger 36.

The refrigerant heat exchanger 36 may be connected to a discharge end of the first outdoor heat exchanger 12. That is, the first and second refrigerants condensed in the first outdoor heat exchanger 12 may be condensed again in the refrigerant heat exchanger 36. Here, emitted heat may be transferred into the third refrigerant. Thus, the third refrigerant circulating into the third refrigerant cycle 30 absorbs heat in the refrigerant heat exchanger 36, and thus is evaporated.

In the cooling mode, the third refrigerant discharged from the third compressor 31 may pass through the third outdoor heat exchanger 32 and be introduced into the third indoor heat exchanger 33 or the refrigerant heat exchanger, and then be evaporated.

On the other hand, in the heating mode, the third refrigerant discharged from the third compressor 31 may pass through the third indoor heat exchanger 33 and be introduced into the third outdoor heat exchanger 32 or the refrigerant heat exchanger 36, and then be evaporated.

According to the current embodiment, since a portion of the third refrigerant absorbs heat from the first refrigerant circulating into the first refrigerant cycle 10 and the second refrigerant circulating into the second refrigerant cycle 20 and then is evaporated, evaporation efficiency of the third refrigerant cycle 30 may be improved.

Alternatively, in the current embodiment, the refrigerant heat exchanger 36 may be omitted. Thus, the third refrigerant may be introduced into the first outdoor heat exchanger 12. In this case, the first outdoor heat exchanger 12 may be configured to heat-exchange the refrigerants with each other, i.e., to heat-exchange the first refrigerant and the second refrigerant with the third refrigerant.

Hereinafter, an operation of the cascade heat pump according to the current embodiment will be descried with reference to FIGS. 2 to 5.

FIGS. 2 to 5 are views illustrating a refrigerant flow in the cascade heat pump according to the first embodiment.

Figure 2:
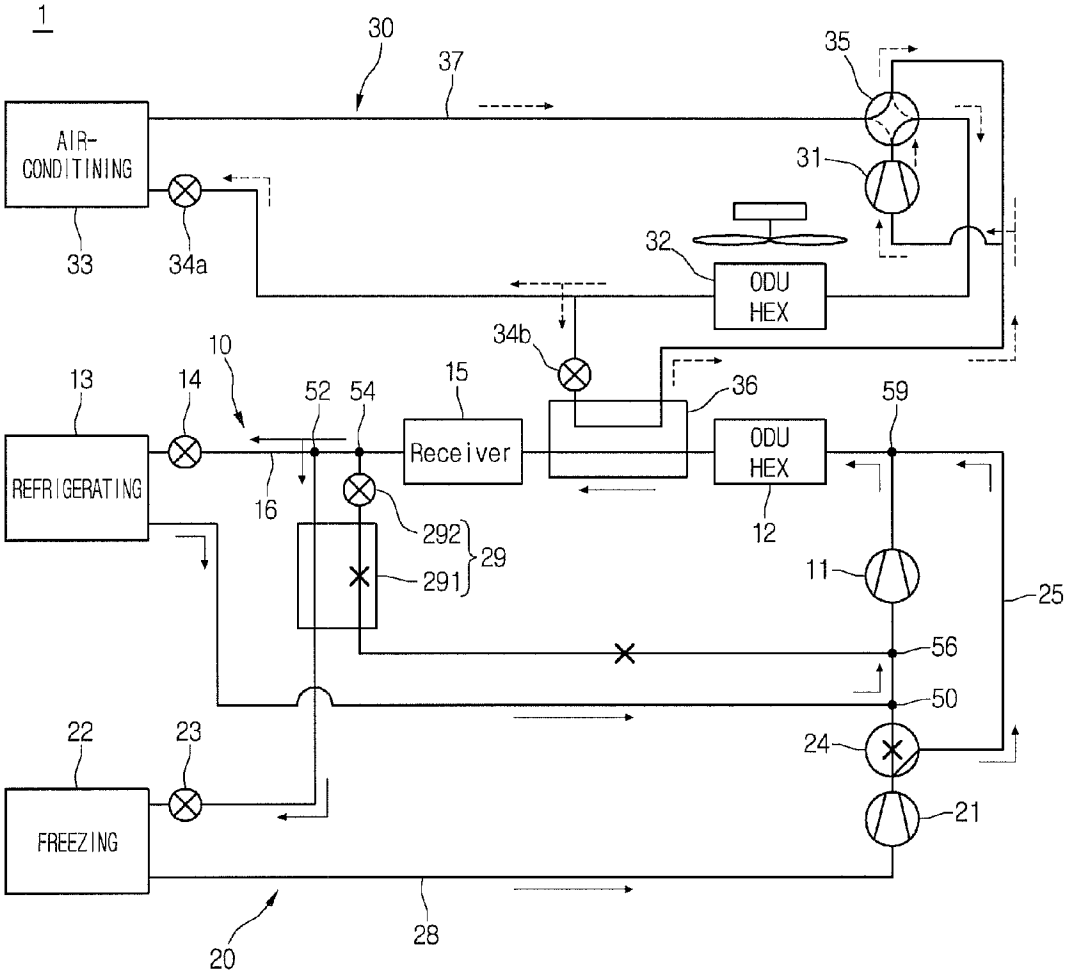
FIGS. 2 to 5 are views illustrating a refrigerant flow in the cascade heat pump according to the first embodiment.
Figure 3:
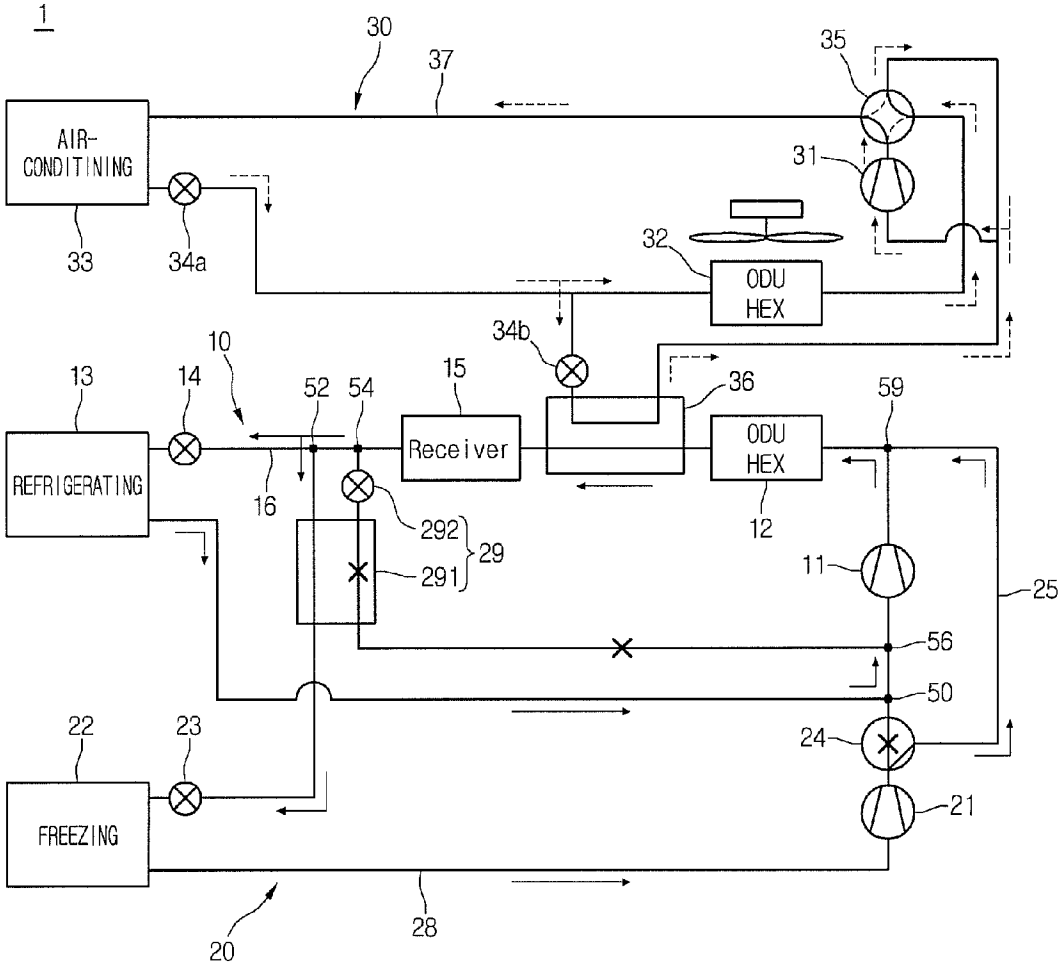

FIG. 2 is a view illustrating a state in which the second refrigerant flows into the bypass tube by bypassing the first compressor, and the third refrigerant is evaporated in the third indoor heat exchanger when the cooling operation in the third refrigerant cycle is performed. FIG. 3 is a view illustrating a state in which the second refrigerant flows into the bypass tube by bypassing the first compressor, and the third refrigerant is evaporated in the third indoor heat exchanger when the cooling operation in the third refrigerant cycle is performed.

Figure 4:
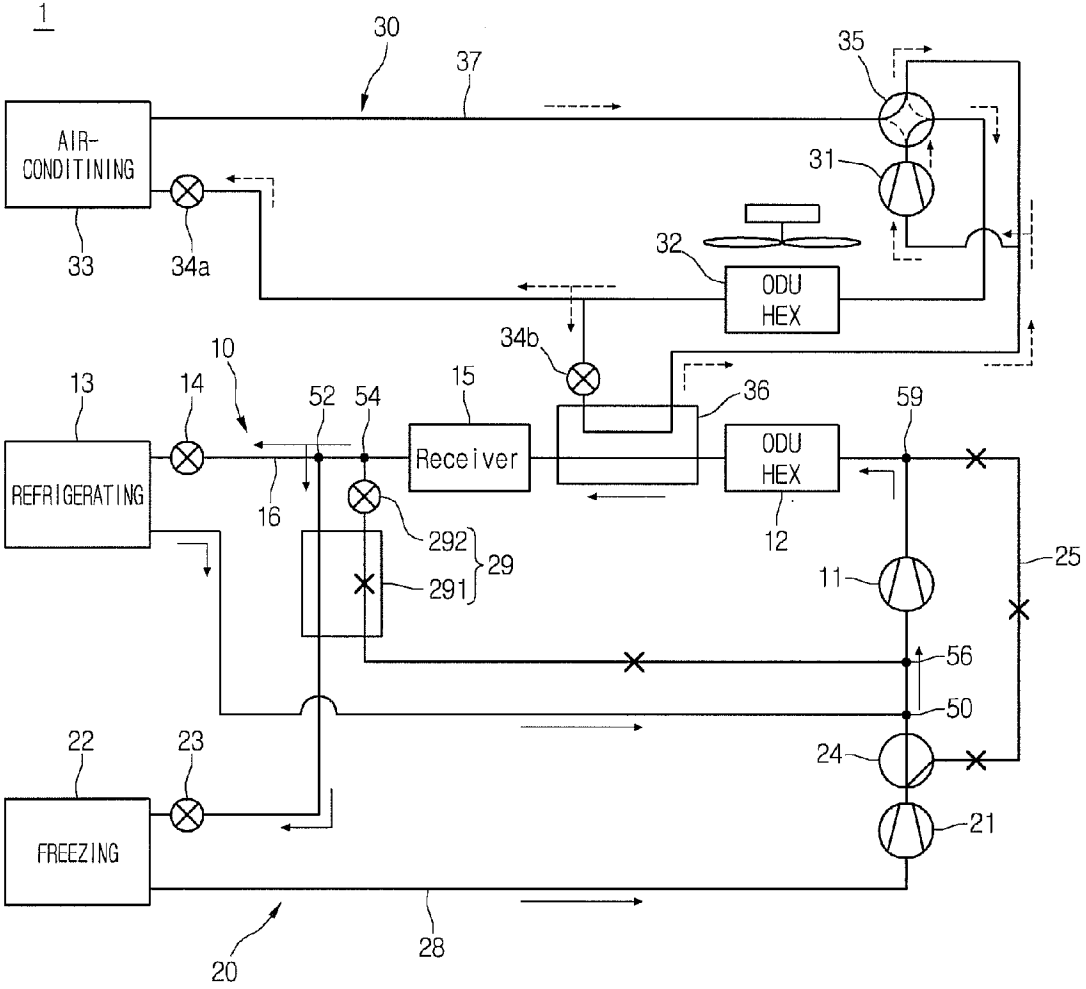
Figure 5:
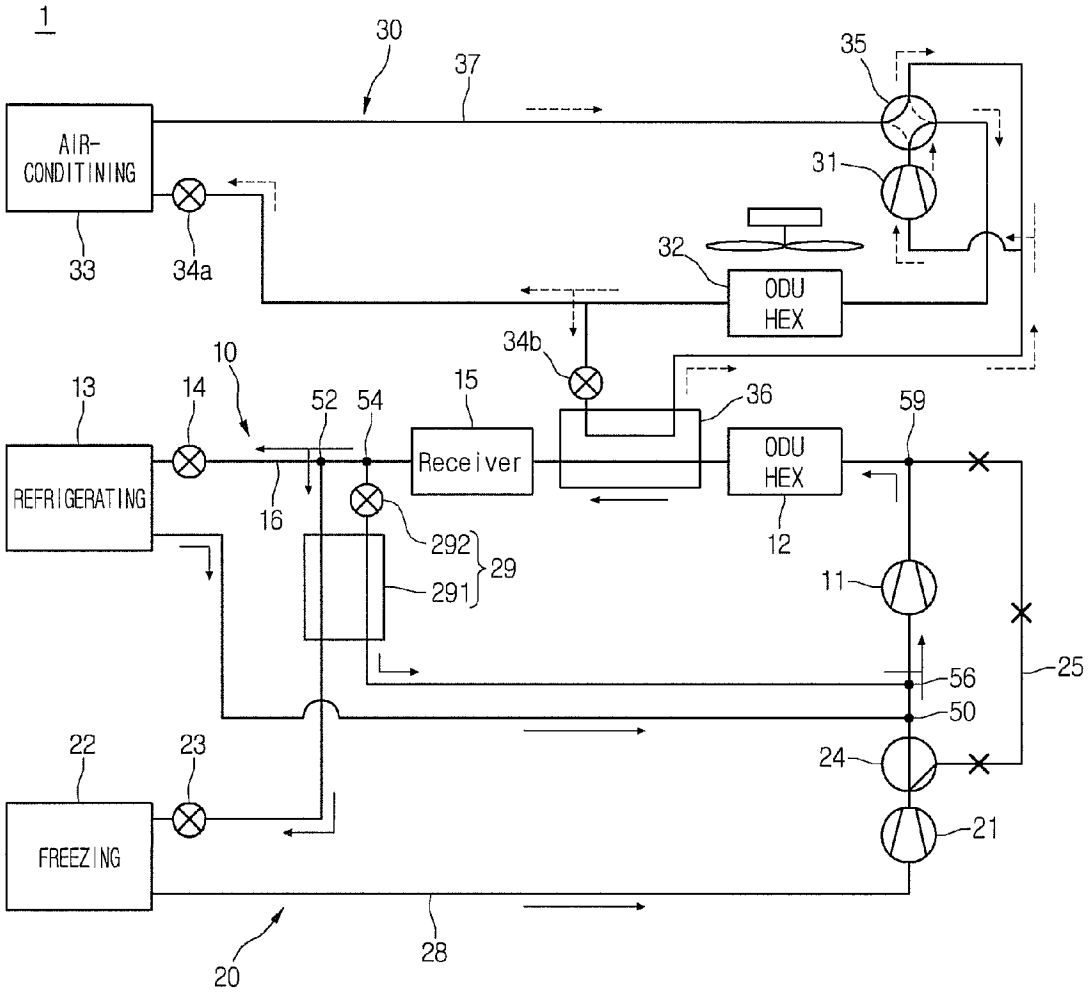

FIG. 4 is a view illustrating a state in which the second refrigerant is compressed in two stages. FIG. 5 is a view illustrating a state in which the second refrigerant is compressed in two stages and thus is supercooled.

Referring to FIG. 2, the first refrigerant is compressed in the first compressor 11 and then is condensed in the outdoor heat exchanger 12. Then, the first refrigerant is heat-exchanged with the third refrigerant in the refrigerant heat exchanger 36, and then passes through the receiver 15 and is evaporated in the first indoor heat exchanger 13.

The second refrigerant is compressed in the second compressor 21 and then is condensed in the first outdoor heat exchanger 12. Then, the second refrigerant is heat-exchanged with the third refrigerant in the refrigerant heat exchanger 36, and then passes through the receiver 15 and is evaporated in the second indoor heat exchanger 22. Here, the second refrigerant discharged from the second compressor 21 may flow along the bypass tube 25 by the first flow rate regulating part 24 and be introduced toward a discharge end of the first compressor 11.

That is, the first and second refrigerants may be compressed in the first and second compressor 11 and 21, respectively. Also, the compressed first and second refrigerants may be mixed with each other and then introduced into the first outdoor heat exchanger 12.

The third refrigerant is compressed in the third compressor 21 and then is condensed in the third outdoor heat exchanger 32. Then, the third refrigerant is evaporated in the third indoor heat exchanger 33 or the refrigerant heat exchanger 36. That is, at least one portion of the third refrigerant passing through the third outdoor heat exchanger 32 may be introduced into the third indoor heat exchanger 33, and the rest refrigerant may be introduced into the refrigerant heat exchanger 36. Here, the third refrigerant cycle 30 may be a cycle for performing the cooling operation.

Referring to FIG. 3, the first and second refrigerants circulate through the same direction as that illustrated in FIG. 2. However, the third refrigerant circulates in a reverse direction. That is, the third refrigerant may be compressed in the third compressor 31 and then be condensed in the third indoor heat exchanger 33. Then, the third refrigerant may be evaporated in the third outdoor heat exchanger 32 or the refrigerant heat exchanger 36. Here, the third refrigerant cycle 30 may be a cycle for performing the heating operation.

Referring to FIG. 4, the first refrigerant circulates in the same direction as that illustrated in FIGS. 2 and 3. On the other hand, the second refrigerant may be compressed in the second compressor 21 and then be introduced into the first compressor 11 by the first flow rate regulating part 24. The second refrigerant may be compressed again in the first compressor 11. As a result, in FIG. 4, the second refrigerant may be compressed in two stages.

The operation for introducing the second refrigerant into the first compressor 11 by the first flow rate regulating part 24 may be performed in a case where external air has a temperature greater than a reference value, e.g., in summer. In summary, when the external air has a relatively high temperature, the second refrigerant should be sufficiently compressed to operate the freezing cycle. If the second refrigerant is compressed only using the second compressor 21, a large amount of electricity may be consumed to reduce efficiency. As a result, the second refrigerant may be compressed in two stages.

According to the current embodiment, the second refrigerant may be compressed in one stage or two stages according to a temperature of the external air. Thus, heat exchange efficiency may be improved, and power consumption may be reduced.

Referring to FIG. 5, a portion of the refrigerant passing through the receiver 15 may be supercooled. In detail, a portion (the branched refrigerant) of the refrigerant passing through the receiver 15 is branched by the second branch part 54, expanded by the supercooling expander 292, and evaporated in the supercooling heat exchanger 291. Also, the rest refrigerant (the second refrigerant) of the refrigerant may be heat-exchanged with the branched refrigerant and be supercooled while passing through the supercooling heat exchanger 291.

Here, the branched refrigerant evaporated in the supercooling heat exchanger 291 may be mixed with the first refrigerant circulating into the first refrigerant tube 16 in the second joint part 56 and then be introduced into the first compressor 11.

Figure 6:
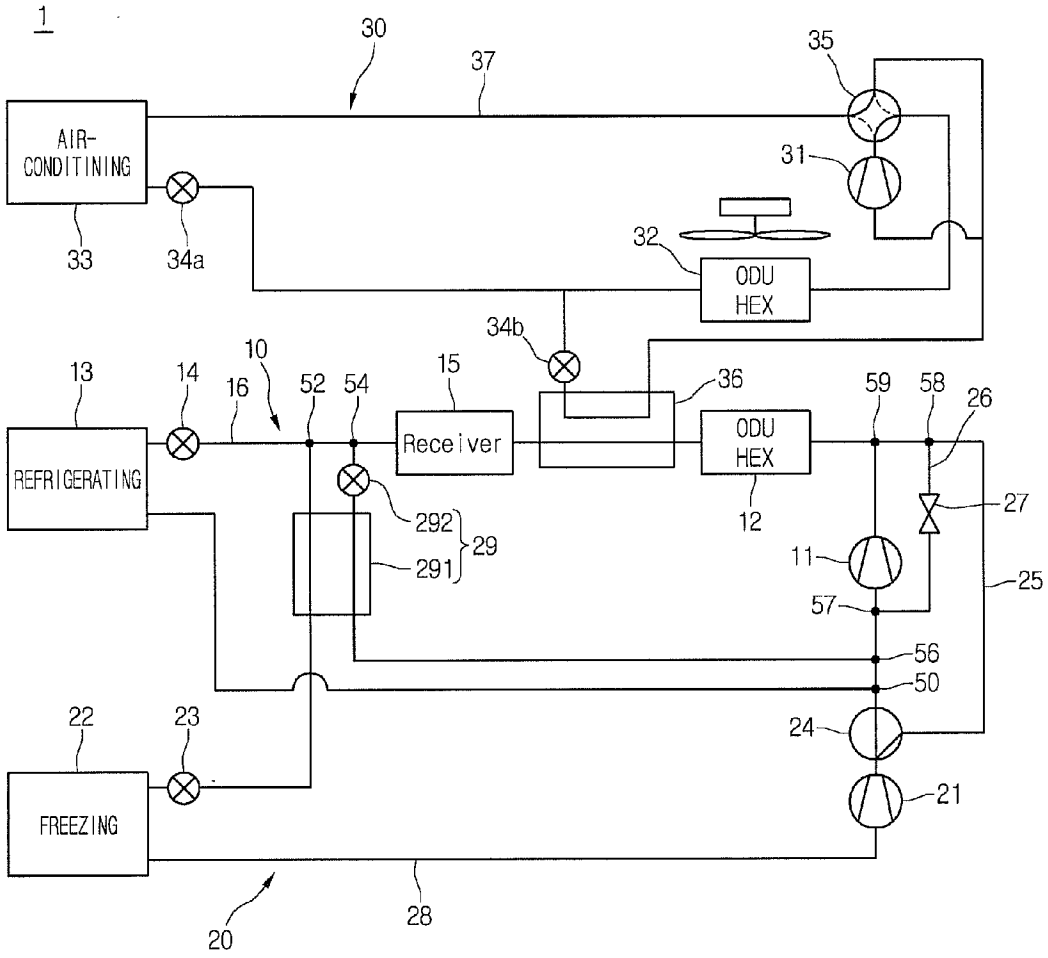
FIG. 6 is a view of a cascade heat pump according to a second embodiment.

FIG. 6 is a view of a cascade heat pump according to a second embodiment.

Referring to FIG. 6, a cascade heat pump 1 according to the second embodiment includes a first refrigerant cycle 10, a second refrigerant cycle 20, and a third refrigerant cycle 30.

The heat pump 1 according to the current embodiment may further include an equilibrium pressure tube 26 disposed on a side of a first compressor 11 so that a refrigerant is bypassed and a second flow rate regulating part 27 disposed in the equilibrium pressure tube 26. Since the first refrigerant cycle 10, the second refrigerant cycle 20, and the third refrigerant cycle 30 have the same configuration as those of the first refrigerant cycle 10, the second refrigerant cycle 20, and the third refrigerant cycle 30 according to the first embodiment, their detailed description will be omitted.

The equilibrium pressure tube 26 is connected to one end and the other end of the first compressor 11 to adjust a pressure in a discharge end of the first compressor 11. In detail, a first refrigerant tube 16 includes a third branch part 57 disposed on a suction side of the first compressor 11 to branch at least one portion of the refrigerant into the equilibrium pressure tube 26 and a third joint part 58 disposed on a discharge side of the first compressor 11 to join the refrigerant within the equilibrium pressure tube 26 into a first refrigerant tube 16. The third branch part 57 is disposed between the first joint part and the first compressor 11.

The equilibrium pressure tube 26 may allow at least one portion of the refrigerant introduced into the first compressor 11 to be bypassed, thereby flowing into the discharge end of the first compressor 11. Thus, a pressure difference between an inflow end and the discharge end of the first compressor 11 may be reduced. As a result, a load of the first compressor 11 may be reduced to secure operation reliability of the first compressor 11.

The second flow rate regulating part 27 may be disposed in the equilibrium pressure tube 26 to control an opened degree of the equilibrium pressure tube 26. The second flow rate regulating part 27 may be a check valve.

When a first flow rate regulating part 24 is controlled so that the second refrigerant is introduced into the first compressor 11, the equilibrium pressure tube 26 may be opened. Also, when the second refrigerant is introduced into the bypass tube 25, the equilibrium pressure tube 26 may be closed.

In summary, in a case where the second refrigerant is compressed in one stage, a load of the first compressor 11 is not large. Thus, even though the equilibrium pressure tube 26 is not used, sufficient reliability may be secured. On the other hand, in a case where the second refrigerant is compressed in two stages, a pressure difference between the inflow end and the discharge end of the first compressor 11 may be increased to deteriorate performance of the first compressor 11.

Thus, in the case where the second refrigerant is compressed in the two stages, the second flow rate regulating part may open the equilibrium pressure tube 26 to reduce the load of the first compressor 11, thereby improving the operation efficiency of the first compressor 11. That is, when external air has a temperature greater than a reference value, it may be understood that the second flow rate regulating part 27 opens the equilibrium pressure tube 26.

When the refrigerant flows along the equilibrium pressure tube 26, in a case where a pressure difference between the inflow end and the discharge end of the first compressor 11 is less than a preset pressure, the second flow rate regulating part 27 may be controlled to block a flow of the refrigerant into the equilibrium pressure tube 26. That is, the second flow rate regulating part 27 may control an opened degree of the equilibrium pressure tube 26 according to a pressure difference between the inflow end and the discharge end of the first compressor 11.

The heat pump 1 includes a suction pressure detection part for detecting a pressure of the suction side of the first compressor 11 and a discharge pressure detection part 130 for detecting a pressure of the discharge side of the first compressor 11. When a difference between a discharge pressure and a suction pressure of the first compressor 11 is less than a preset pressure on the basis of information recognized by the detection parts 120 and 130, the second flow rate regulating part 27 may be closed to prevent the refrigerant from flowing into the equilibrium pressure tube 26.

Hereinafter, an operation of the cascade heat pump according to the current embodiment will be described with reference to FIGS. 8 to 10.

Figure 8:
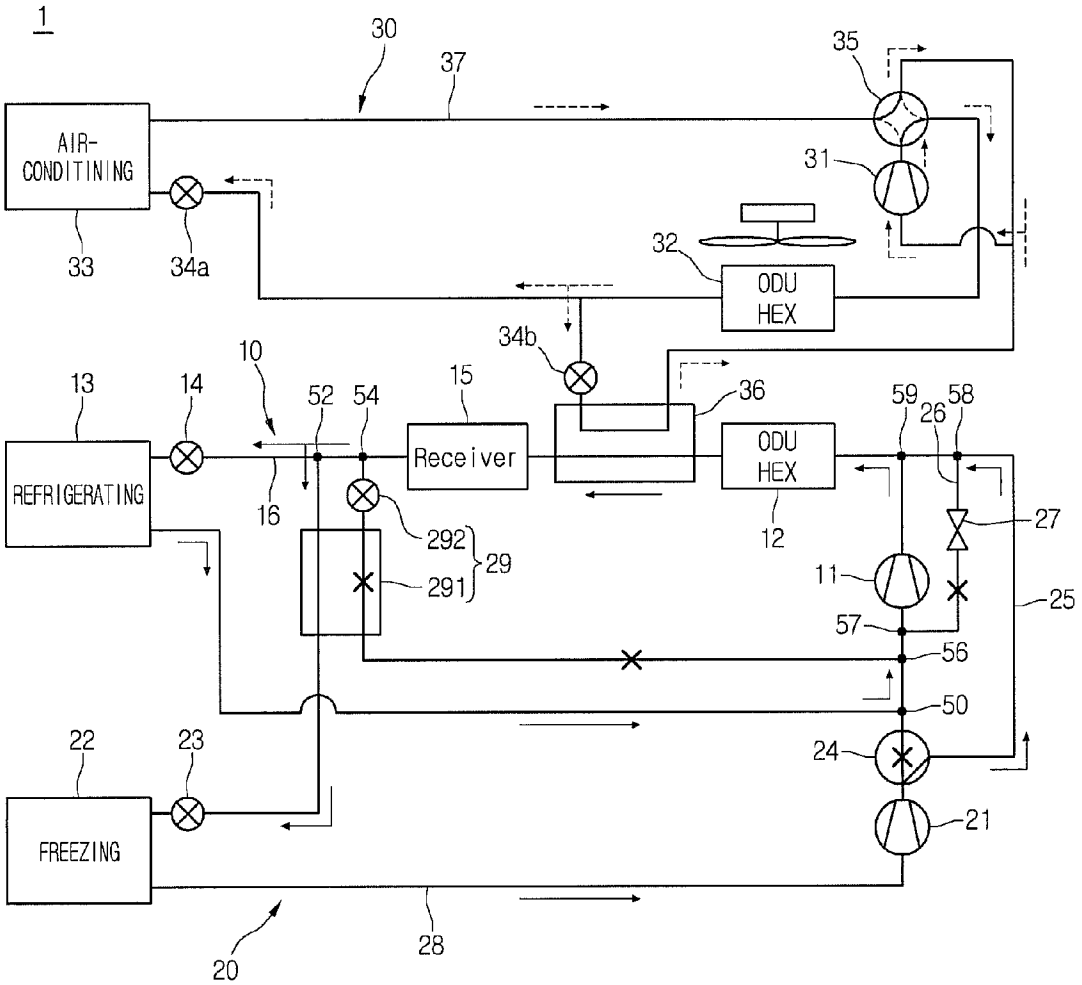
FIGS. 8 to 10 are views illustrating a refrigerant flow in the cascade heat pump according to the second embodiment.
Figure 9:
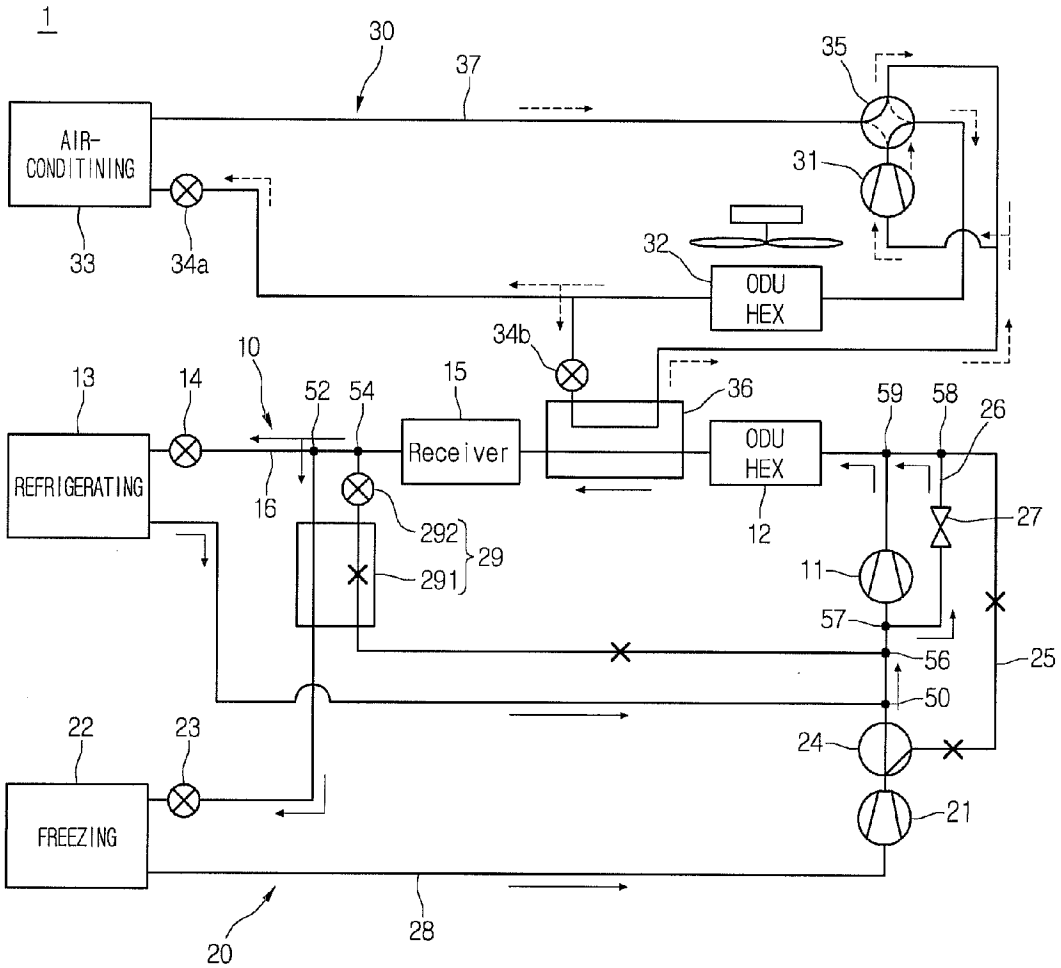
Figure 10:
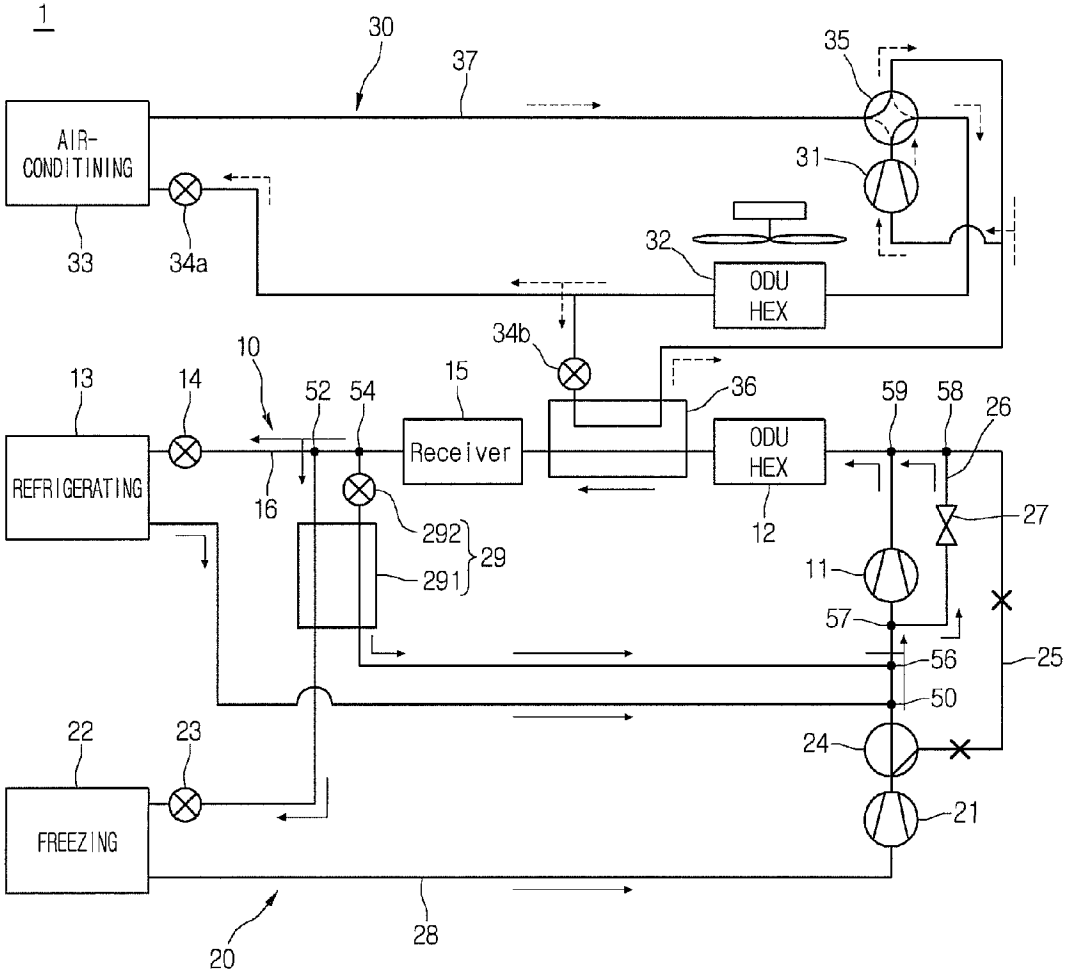

FIGS. 8 to 10 are views illustrating a refrigerant flow in the cascade heat pump according to the second embodiment.

FIG. 8 is a view illustrating a state in which the second refrigerant bypasses the first compressor. FIG. 9 is a view illustrating a state in which the second refrigerant is compressed in two stages. FIG. 10 is a view illustrating a state in which the second refrigerant is compressed in two stages and thus is supercooled.

Referring to FIG. 8, the first refrigerant is compressed in the first compressor 11 and is condensed in a first outdoor heat exchanger 12. Then, the first refrigerant is heat-exchanged with a third refrigerant in a refrigerant heat-exchanger 36. Also, the first refrigerant passes through a receiver 15 and is evaporated in the first indoor heat exchanger 13.

The second refrigerant is compressed in the second compressor 21 and is condensed in the first outdoor heat exchanger 12. Then, the second refrigerant is heat-exchanged with the third refrigerant in the refrigerant heat exchanger 36. Also, the second refrigerant passes through the receiver 15 and is evaporated in a second indoor heat exchanger 22. Here, the second refrigerant discharged from the second compressor 21 may bypass the first compressor 11 along the bypass tube 25 by the first flow rate regulating part 24. Then, the second refrigerant may be mixed with the first refrigerant in a fourth joint part 59 and be introduced into the first outdoor heat exchanger 12.

In summary, the first refrigerant and the second refrigerant may be compressed in the first compressor 11 and the second compressor 21, respectively. The compressed first and second refrigerants may be mixed with each other and then be condensed in the first outdoor heat exchanger 12.

Referring to FIG. 9, the second refrigerant may be compressed in the second compressor 21, and then be introduced into the first compressor 11 via the first flow rate regulating part 24.

Also, the second flow rate regulating part 27 opens the equilibrium pressure tube 26, and thus, at least one portion of the refrigerant of a suction side of the first compressor 11 bypasses the first compressor 11 to flow into the discharge end of the first compressor 11. Thus, since a pressure difference between front and rear ends of the first compressor 11 is reduced, the load of the first compressor 11 may be reduced to improve the operation efficiency of the first compressor 11.

Referring to FIG. 10, the second refrigerant may be supercooled after being compressed in two stages. A process for supercooling the second refrigerant is equal to that described in FIG. 5, their detailed description will be omitted.

Figure 11:
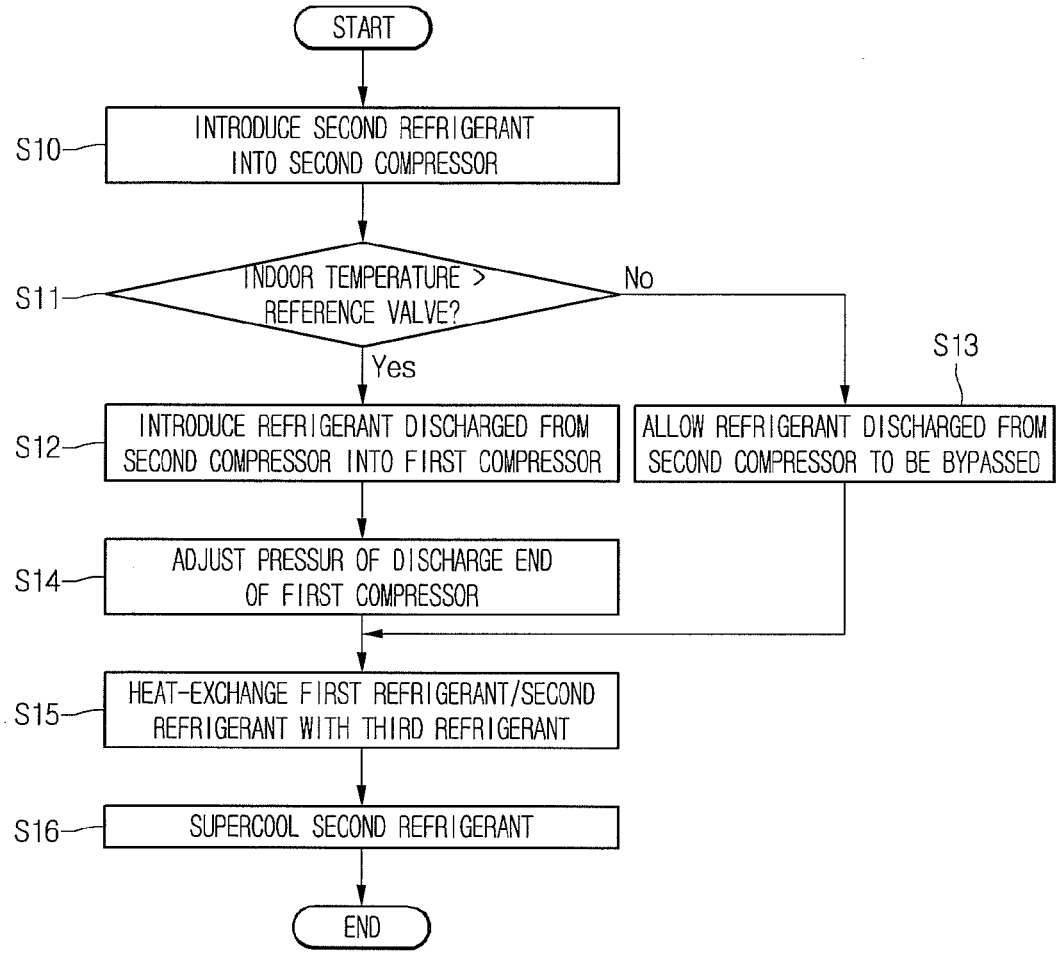
FIG. 11 is a flowchart illustrating an operation method of the cascade heat pump according to the second embodiment.

FIG. 11 is a flowchart illustrating an operation method of the cascade heat pump according to the second embodiment.

Referring to FIG. 11, in a cascade heat pump 1 according to the second embodiment, a second refrigerant may be introduced into a second compressor 21 (S10), and then, a refrigerant discharged from the second compressor 21 may be introduced into a first compressor 11 (S12) when a preset condition is satisfied (S10). Here, the preset condition may represent that external air has a temperature greater than a reference value.

Since a portion of the refrigerant to be introduced into the first compressor 11 is bypassed to flow into a discharge side of the first compressor 11, a pressure difference between an inflow end and a discharge end of the first compressor 11 may be adjusted, and thus, reliability of the first compressor 11 may be secured (S14).

However, if the preset condition is not satisfied, the refrigerant discharged from the second compressor 21 may be bypassed to mix the refrigerant with a first refrigerant discharged from the first compressor 11 in a fourth joint part 59 (S13).

Thereafter, the first or second refrigerant may be heat-exchanged with a third refrigerant in a refrigerant heat exchanger 36 (S15), and also, the second refrigerant may be supercooled (S16). The supercooled second refrigerant is evaporated in a second indoor heat exchanger 22. Also, the first refrigerant may be evaporated in a first indoor heat exchanger 13.

According to the above-described control method, the second refrigerant may be compressed in one stage or two stages by comparing the temperature of the external air to the reference value to obtain a high compression ratio and reduce power consumption. Also, when the second refrigerant is compressed in the two stages, a pressure difference between an inflow end and a discharge end of the first compressor 11 may be adjusted to secure the operation reliability of the compressor.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. Therefore, contents with respect to various variations and modifications will be construed as being included in the scope of the present disclosure.

According to the embodiments, since the refrigerant circulating into the freezing cycle may be successively introduced and compressed in the compressor of the freezing cycle and the compressor of the refrigerating cycle, the compression ratio of the freezing cycle may be improved.

Also, when the external air has a relatively low temperature, the refrigerants circulating into the refrigerating cycle and the freezing cycle may be compressed using one compressor. On the other hand, when the external air has a relatively high temperature, the refrigerant circulating into the freezing cycle may be compressed in the two stages through the compressor of the freezing cycle and the compressor of the refrigerating cycle to reduce the power consumption.

Also, when the refrigerant circulating into the freezing cycle is compressed in the two stages, the pressure difference between the inflow end and the discharge end of the refrigerating cycle compressor may be in equilibrium to secure the operation reliability of the compressor.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cascade heat pump, comprising:

a first refrigerant cycle including a first compressor and a first indoor heat exchanger;

a second refrigerant cycle including a second compressor and a second indoor heat exchanger;

an outdoor heat exchanger in which a refrigerant compressed in the first compressor and the second compressor is condensed;

a bypass tube that allows the refrigerant compressed in the second compressor to bypass the first compressor, thereby flowing into a discharge side of the first compressor;

a first flow rate regulator provided on a discharge side of the second compressor to introduce the refrigerant discharged from the second compressor into one of the first compressor or the bypass tube;

a third refrigerant cycle provided on a side of the first refrigerant cycle or the second refrigerant cycle, the third refrigerant cycle including a third compressor, a third indoor heat exchanger to perform a cooling or heating operation, and a refrigerant heat exchanger in which the refrigerant discharged from the outdoor heat exchanger and the refrigerant circulating into the third refrigerant cycle are heat-exchanged with each other;

a first refrigerant tube provided in the first refrigerant cycle to guide a flow of the refrigerants circulating into the first compressor and the first indoor heat exchanger; and a second refrigerant tube provided in the second refrigerant cycle to guide a flow of the refrigerants circulating into the second compressor and the second indoor heat exchanger, wherein a first end of the bypass tube is connected to the first flow rate regulator and a second end of the bypass tube is connected to a refrigerant tube between the first compressor and the outdoor heat exchanger, wherein the second refrigerant cycle includes:

a supercooling heat exchanger in which at least one portion of the refrigerant discharged from the refrigerant heat exchanger is introduced and heat-exchanged; and a supercooling expander that expands at least one portion of the refrigerant introduced into the supercooling heat exchanger, wherein the first refrigerant tube includes:

a first branch that branches at least one portion of the refrigerant passing through the refrigerant heat exchanger into the second refrigerant tube;

a first joint by which the refrigerant passing through the first flow rate regulator flows into the first refrigerant tube;

a second branch that introduces at least one portion of the refrigerant condensed in the refrigerant heat exchanger into the supercooling expander; and a second joint by which the refrigerant passing through the supercooling heat exchanger flows into the first refrigerant tube, and wherein the first flow rate regulator is provided between a discharge end of the second compressor and the first joint.

2. The cascade heat pump according to claim 1, wherein the third refrigerant cycle further includes a third outdoor heat exchanger provided on a side of the refrigerant heat exchanger to heat-exchange the refrigerant circulating in the third refrigerant cycle with external air.

3. The cascade heat pump according to claim 1, wherein the third refrigerant cycle further includes:

a third expander provided on a side of the third indoor heat exchanger to decompress the refrigerant; and a fourth expander provided on a side of the refrigerant heat exchanger to decompress the refrigerant.

4. The cascade heat pump according to claim 1, further including:

an equilibrium pressure tube that extends from a discharge side of the first flow rate regulator to the discharge side of the first compressor to allow the refrigerant to bypass the first compressor; and a second flow rate regulator that adjusts an opened degree of the equilibrium pressure tube.

5. The cascade heat pump according to claim 4, further including a controller that controls an opened degree of each of the first flow rate regulator and the second flow rate regulator, wherein the controller controls the first flow rate regulator so that the refrigerant flows into the bypass tube and closes the second flow rate regulator when external air has a temperature less than a predetermined temperature, and wherein the controller controls the first flow rate regulator so that the refrigerant is compressed in two stages in the second compressor and the first compressor and opens the second flow rate regulator when the external air has the temperature greater than the predetermined temperature.

6. The cascade heat pump according to claim 4, further including:

a suction pressure detector that detects a suction side pressure of the first compressor; and a discharge pressure detector that detects a discharge side pressure of the first compressor, wherein when a difference between the discharge side pressure and the suction side pressure of the first compressor is less than a predetermined pressure, the second flow rate regulator is closed.

7. The cascade heat pump according to claim 4, wherein the first flow rate regulator includes a four-way valve, and the second flow rate regulator includes a check valve.

8. The cascade heat pump according to claim 4, wherein the equilibrium pressure tube is connected to the discharge side of the first flow rate regulator so that at least one portion of the refrigerant to be introduced into the refrigerating compressor is bypassed.

9. The cascade heat pump according to claim 4, wherein the second flow rate regulator is provided in the equilibrium pressure tube to selectively block a flow of the refrigerant.

10. The cascade heat pump according to claim 5, further including:

an external air detector that detects a temperature of external air.

* * * * *